United States Patent [19]

Legault

[11] Patent Number: 4,895,010

[45] Date of Patent: Jan. 23, 1990

[54] COMBINATION LOCK WITH SELF-CANCELING MECHANISM

[75] Inventor: Claude Legault, Quebec, Canada

[73] Assignee: C. L. Industries Inc., Pierrefonds, Canada

[21] Appl. No.: 172,249

[22] Filed: Mar. 23, 1988

[51] Int. Cl.[4] ..... E05B 37/00

[52] U.S. Cl. ..... 70/314; 70/443; 292/337

[58] Field of Search ..... 70/314, 303 A, 443; 292/337

[56] References Cited

U.S. PATENT DOCUMENTS

| | | | |
|---|---|---|---|
| 1,317,221 | 9/1919 | Roshon | 70/314 |
| 2,436,859 | 3/1948 | Eras | 70/314 |
| 2,625,032 | 1/1953 | Eiffert et al. | 70/314 |
| 3,235,301 | 2/1966 | Russell et al. | 292/337 |
| 3,369,382 | 2/1968 | Russell et al. | 70/314 |
| 3,447,348 | 6/1969 | Dauenbaugh | 70/314 |
| 4,147,045 | 4/1979 | Testa | 70/314 |
| 4,328,689 | 5/1982 | Keller et al. | 70/314 X |
| 4,687,239 | 8/1987 | Lin | 292/172 |

FOREIGN PATENT DOCUMENTS

| | | | |
|---|---|---|---|
| 780125 | 3/1968 | Canada | 70/314 |

*Primary Examiner*—Lloyd A. Gall

*Attorney, Agent, or Firm*—Swabey Mitchell, Houle, Marcoux & Sher

[57] ABSTRACT

A combination door lock having a self-canceling combination mechanism which is secured inside the lock housing and is provided with spring-biased hook engaging fingers which engage one or more of the combination discs when these discs are aligned at a predetermined position where a retracting cam engages a bolt-retracting lever. Once the bolt is retracted by the lever these hook fingers engage with an associated combination disc and move it out of its predetermined position to a random position thereby scrambling or self-canceling the combination or the placement of the discs. Accordingly, it is not possible to predict the precise position of the combination discs after the bolt has been retracted and the door opened.

12 Claims, 5 Drawing Sheets

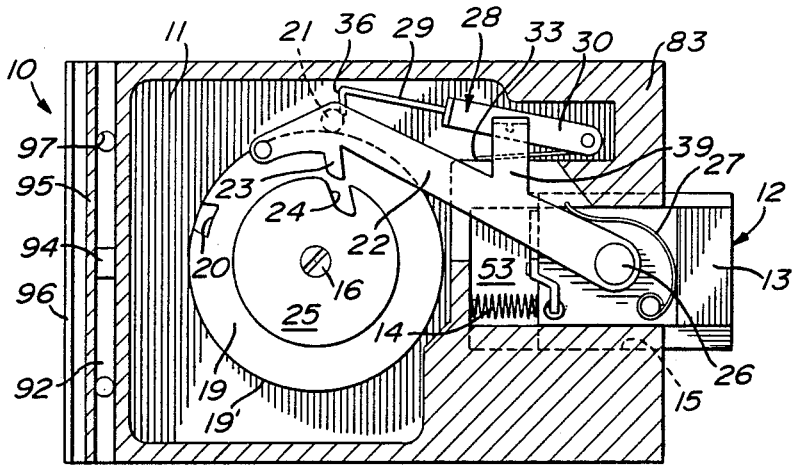
Fig. 1
Fig. 2A
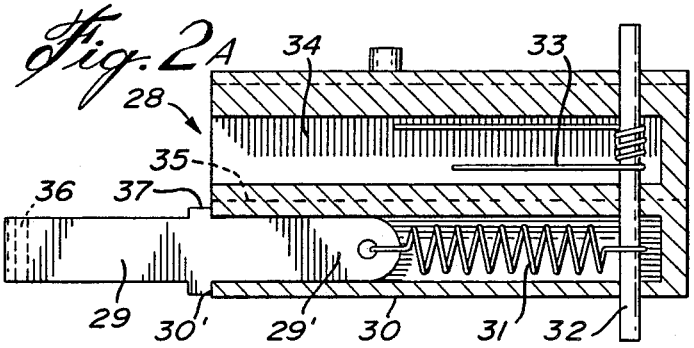
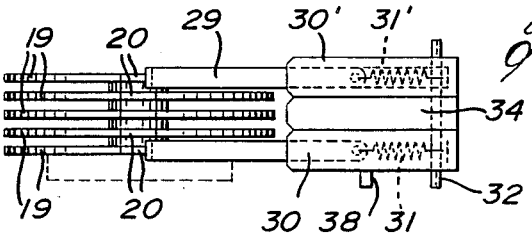
Fig. 2B

COMBINATION LOCK WITH SELF-CANCELING MECHANISM

BACKGROUND OF INVENTION

1. Field of Invention

The present invention relates to a combination door lock, and more particularly to a self-canceling combination mechanism which displaces the position of the combination discs inside the lock after the bolt has been retracted.

2. Description of Prior Art

In U.S. Pat. No. 4,328,689, which is assigned to the Applicant of the present invention, there is described a combination lock with a spring-acutated bolt. The bolt is retracted by positioning a plurality of combination discs, located inside the lock, to a predetermined position, and this is done by rotating a combination dial outside a door on the inside of which the lock housing is secured. In order to retract the bolt, as soon as the combination of the dial has been completed, a plurality of notches in the combination disc are all aligned and a retracting lever support pin enters these notches causing the retracting lever to engage a cam which is secured to the combination dial. By rotating the dial the bolt retracting lever is pulled, and the bolt can be pulled back into the housing and the door opened. With such a combination lock a person may become knowledgeable that once the door has been opened, all of the notches in the combination discs are aligned even after the door has been re-closed, provided the dial has not been rotated to scramble the combination. Thus, if one forgets to scramble the combination, then it only requires easy manipulation of the combination dial by an expert thief to reset the combination.

Another disadvantage of the type of prior art locks as mentioned hereinabove, where the bolt is spring-actuated, is that the bolt can be pushed back into the lock housing by drilling a hole through the doorframe in the direction of the bolt and then inserting a pin element in the hole to push the bolt back into the lock housing.

SUMMARY OF INVENTION

It is a feature of the present invention to provide a self-canceling combination means secured inside the lock housing and wherein one or more of the combination discs are automatically scrambled or displaced as soon as the retracting lever frees the combination discs while retracting the bolt.

Another feature of the present invention is to provide a self-canceling combination means wherein at least two discs are scrambled or displaced to an unknown position, which position is dependent on the spring force of hook fingers which displace the discs and on the speed of rotation of the combination knob which retracts the bolt.

Another feature of the present invention is to provide an internal arresting mechanism for a spring-biased bolt which arrests the bolt in its lock or extended position to prevent the bolt from being pushed back into the lock housing by external means.

Another feature of the present invention is to provide an internal arresting mechanism for a spring-biased bolt and wherein the mechanism is fully automatic, and automatically disengages once the bolt retracting lever has been displaced to engage with a retracting cam of the combination lock.

According to the above features, from a broad aspect, the present invention provides the improvement of a self-canceling combination means secured inside a combination lock housing and having combination disc engaging means for engaging one or more of the combinations discs when the one or more combination discs are positioned at a predetermined position. The disc engaging means displaces an associated engaged disc out of position when a support pin of a retracting lever moves out of the aligned notches provided in the combination discs.

According to a further broad aspect of the present invention, the above-mentioned improvement resides in a combination door lock having a lock housing with a spring-biased bolt having a locking free end. The bolt is spring-biased for sliding movement so that the free end is normally biased extending out of the housing. A manually operable combination element is provided outside the housing and displaces one or more combination discs rotatable upon a common axis. Each of the one or more discs has a notch formed in an outer periphery thereof. A bolt retracting cam is displaceable about the common axis. A bolt retracting lever is pivotally connected to the bolt and has a retracting cam engaging means and a support pin supported on the outer periphery of the discs. The bolt retracting cam has means to engage the retracting cam engaging means. The one or more combination discs when positioned at a predetermined position by the combination element cause the notch(es) to align and the support pin to enter the notch(es) of the one or more discs causing the retracting cam engaging means to engage the bolt retracting cam whereby upon further rotation of the combination element the bolt will be retracted by the bolt retracting lever.

According to a still further broad aspect of the present invention, there is provided an internal arresting mechanism for a spring-biased bolt as used in a door lock having a bolt sliding channel in which the bolt is slidingly captive. The bolt has a locking free end and is spring-biased for sliding movement so that the free end is normally biased extending out of the housing. A lock bar receiving cavity is provided in a side wall of the channel. A lock bar is pivotally secured to the bolt and has an arresting free end portion for entry into the cavity. An actuating member is provided for permitting positioning of the lock bar in the cavity and has a pusher end which engages a doorframe edge to displace the actuating member inwardly of the sliding channel to cause the arresting end portion to enter the cavity to arrest sliding movement of the bolt. The lock bar further has actuating means at an end opposed to the arresting free end portion to automatically move the lock bar in and out of the cavity.

BRIEF DESCRIPTION OF DRAWINGS

The present invention will now be described with reference to the examples thereof as illustrated in the accompanying drawings in which:

FIG. 1 is a fragmented simplified rear view of a combination door lock housing having the self-cancelling combination mechanism of the present invention;

FIG. 2A is a bottom section view showing the construction of the self-canceling combination mechanism of the present invention;

FIG. 2B is a top view showing a variant of the self-canceling combination mechanism of the present invention and aligned with two combination discs;

DESCRIPTION OF PREFERRED EMBODIMENTS

Figure 3:
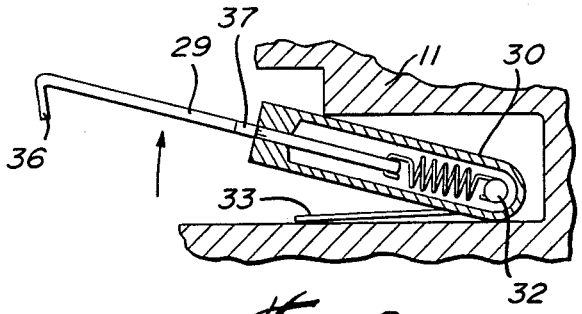
FIG. 3 is a section view showing the self-canceling combination mechanism in its non-engaged position.

Referring now to the drawings, and more particularly to FIG. 1, there is shown generally at 10 a combination door lock, and wherein the lock mechanism is located in the lock housing 11. A spring-biased bolt 12 having a locking free end 13 is spring-biased by the spring 14 for sliding movement in a sliding channel 15 so that the free end 13 is normally biased extending out of the housing 11.

Figure 6:
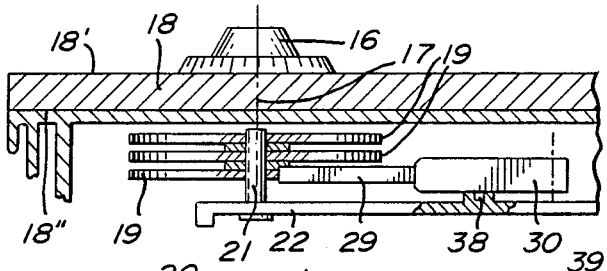
FIG. 6 is a simplified fragmented top view showing the self-canceling combination mechanism of FIG. 5 in its engaged position.

As shown in FIG. 6, a manually operable combination element 16 is connected to the main shaft 17 of the lock and is located exteriorly of the housing, and usually mounted on the exterior surface 18' of a door wall 18 with the lock secured to the inside surface 18" of the door. By rotating the combination element 16, combination discs 19 located within the lock housing are rotated whereby to locate the notch 20 associated with each disc to a predetermined position, as illustrated in FIG. 6. Once the entire combination or rotation of the combination element 16 has been completed, all of the notches 20 of the discs 19 are in alignment thus permitting a support pin 21 secured to a retracting lever 22 to enter into the cavity formed by the aligned notches 20 thereby causing a lever retracting finger 23 to enter into a cam notch 24 positioned in alignment thereunder and associated with a retracting cam 25. By further rotation of the combination element 16 the cam 25 is rotated and the bolt retracting lever 22 is displaced to retract the bolt 12. As herein shown, the other end of the bolt retracting lever 22 is pivotally secured at its pivotal connection 26 with the bolt. A leaf spring 27 biases the retracting lever downwardly towards the retracting cam 25.

Referring now additionally to FIGS. 2 to 9, there will be described the operation of the self-canceling mechanism 28 which is disposed in an upper part of the housing 11 above the combination discs 19. As more clearly shown in FIG. 2, the self-canceling mechanism 28 comprises essentially a disc engaging spring-biased hook finger 29 which is slidingly engaged in a housing 30 and connected at an inner end 29' to a spring 31 which is secured to a pivot pin 32. The housing 30 is biased in an upward direction, as shown in FIG. 1, by a spring 33 also secured about the pivot pin 32 and located in a spring housing 34 which is formed integral with the housing 30 or mated thereto by a mating spline 35. The free end of the finger 29 has a hook end 36 to engage with the outer edge of a notch 20 of an associated combination disc 19. Although only one engaging finger 29 is shown in FIGS. 2A and 6, it can be seen in FIG. 2B that two or more of these fingers 29 can be provided and aligned with selected ones of the discs 19. Blank housings, such as the spring housing 34, may be provided as spacers depending on the number of discs 19 to be engaged. As herein shown, the hook fingers 29 are elongated flat fingers and are provided with a stop flange portion 37 in an edge thereof to abut against the front end 30' of the housing 30 to limit the inner travel of the finger 29 in the housing.

Figure 4:
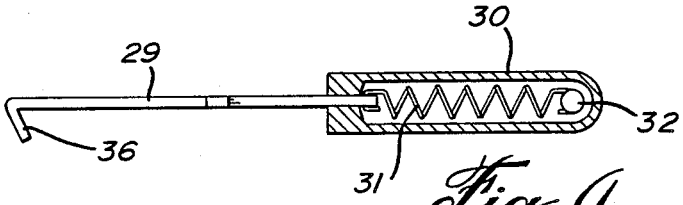
FIG. 4 is a view similar to FIG. 3 but showing the hook finger of the mechanism in an engaged position.
Figure 5:
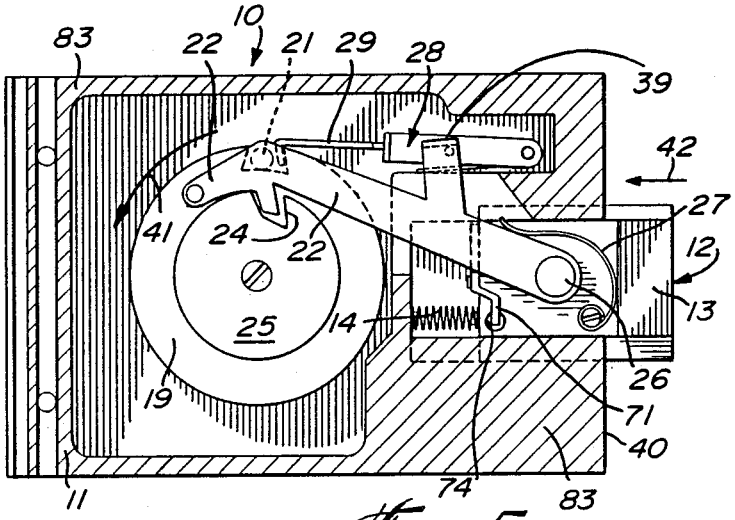
FIG. 5 is a view similar to FIG. 1 but showing the retracting cam and retracting lever engaged for retracting the lock bolt with the self-canceling combination mechanism engaged with the combination discs.
Figure 7:
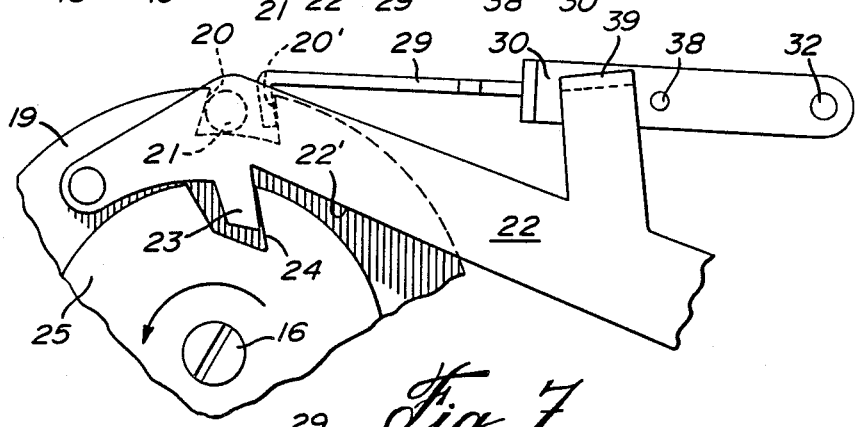
FIG. 7 is a fragmented view showing the displacement of the combination discs by the bolt retracting cam prior to the scrambling of the discs by the self-canceling mechanism.
Figure 8:
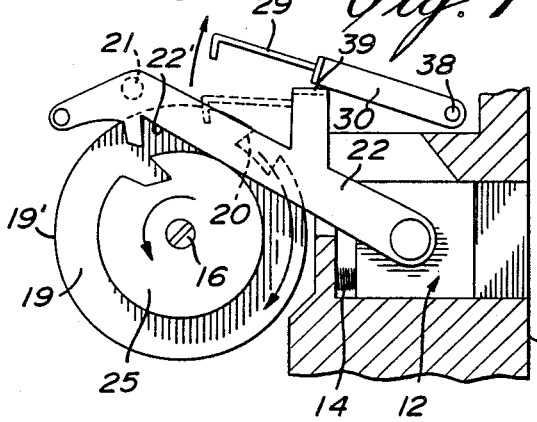
FIG. 8 shows the scrambling operation of the self-canceling mechanism.

The housing 30 of the self-canceling mechanism 28 is also provided in a side wall thereof with an engaging means in the form of a pin 38 which is aligned with a flange 39 secured to the bolt retracting lever 22 whereby when the lever 22 drops into the bolt retracting notch 24 of the cam 25 it will engage with the pin 38 and pull down the housing 30 of the self-canceling mechanism 28 thereby locating the flat fingers 29 on the outer periphery 19' of the discs 19 with the hook end 36 extending into the notch 20, which have now all been aligned above these hook ends 36. Thus, the self-canceling mechanism 28 assumes its engaged position as illustrated in FIG. 5. As the manually operable combination element 16 is further turned to retract the bolt locking free end 13 within the housing end wall 40 by rotating the combination discs 19 counterclockwise in the direction of arrow 41, the retracting lever 22 will move in the direction of arrow 42. Because the hook end 36 is engaged with the end edge 20' of an associated notch 20, this will pull the finger 29 outside its associated housing 30, as shown in FIG. 4, stretching the spring 31 thus subjecting the finger 29 to an increased retracting force. This position relative to the cam is also illustrated in FIG. 7. However, by further rotating the retracting cam the retracting lever 22 is pushed upwards by the periphery of the cam acting on its lower edge 22' and moves the support pin 21 out of the notches 20, as shown in FIG. 8. At the instant the support pin 21 clears the notches 20, the combination discs are freely rotatable, and the spring-loaded finger 29 quickly moves back into its housing 28 pulling on the notch edge 20' and causing the wheel to be displaced clockwise to an unknown distance depending on the spring load of the finger 29 and also on the speed at which the retracting cam 25 is rotated. As shown in FIG. 8, the lever retracting finger 23 is still engaged in the cam notch to retract the bolt 12 and open the door. As soon as the combination element 16 is released, the retracting cam become freely retractable and the spring force of the spring 14 urges the bolt 12 outwards to a locking position. This moves the pin 21 to the top of the periphery of the discs 19 (see FIG. 1) to disengage the retracting cam 25 from the lever 22.

Figure 9:
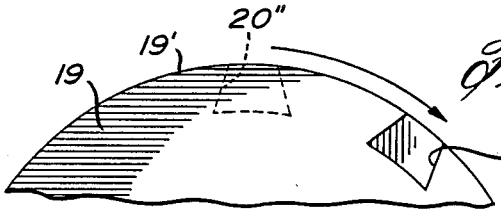
FIG. 9 shows the position of the combination disc that has been scrambled.
Figure 10:
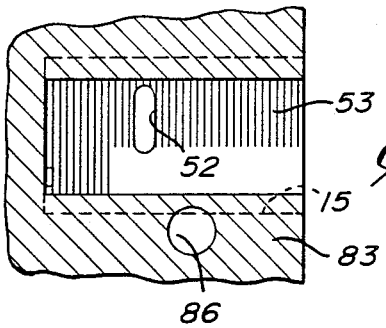
FIG. 10 is a fragmented side view of the housing showing the bolt sliding channel.
Figure 12:
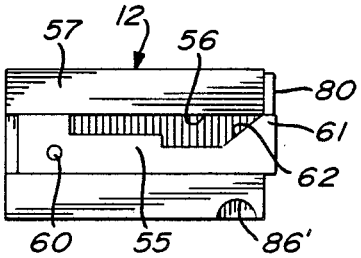
FIG. 12 is a plan view of the inner side wall of the bolt.

In the embodiment as shown in FIG. 2B, it is also conceived that the spring 31' of the second housing 30' be provided with a different spring tension so as to displace its associated disc to a different angle or position from that of the other disc engaged by the other finger 29. Because of the displacement of the retracting lever 22 in the direction of arrow 42, the flange 39 is no longer aligned with the pin 38 secured to the housings 34 and 30', and consequently as soon as the support pin 21 moves out of the notches, these housings are also moved upwardly by the spring 33 to assume its normal position as shown in FIG. 1. FIG. 9 shows a disc 19 of which the notch 20 has been offset from the aligned notches 20" of an adjacent disc. Accordingly, one or more of the notches in the disc have been displaced out of alignment to an unknown location making it impossible for a person to open the lock by assuming that the notches are all aligned. Also, if a person forgets to scramble the combination element 16, there is still no danger in providing for one to easily open this combination. In fact, with this invention it is not essential to scramble the lock after the bolt has been retracted.

Referring now to FIGS. 10 to 16 there will be described the construction and operation of the spring-biased bolt 12 and in particular an arresting mechanism associated therewith to arrest the displacement of the bolt 12 in its sliding channel 15. It is desirable to provide an arresting mechanism with the sliding bolt in order to prevent the bolt from being pushed back into its sliding channel by any means capable of being placed on its locking free end 13.

Figure 16:
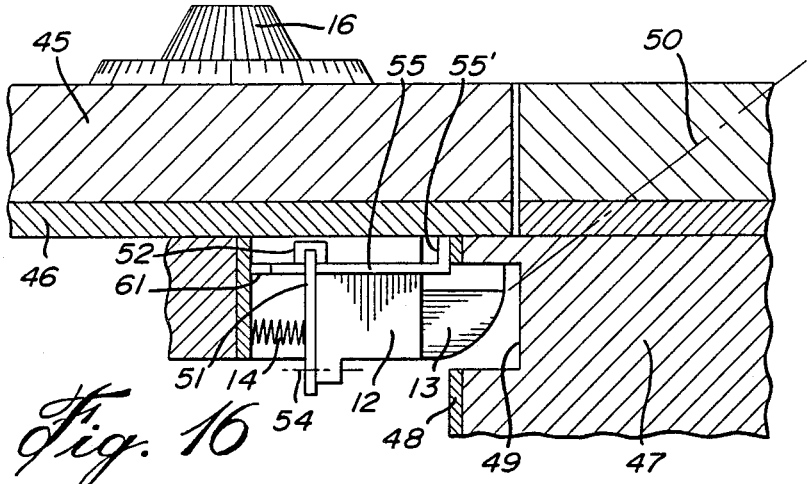
FIG. 16 shows the position of the lock bolt in a door-frame.

As shown in FIG. 16, the lock housing 11 is secured to a door 45 having a steel plate 46. This door is positionable within the doorframe 47 by engaging a striker plate 48, as is well known in the art, and entering into a bolt receiving locking cavity 49. However, with spring loaded bolts it is possible to push back the bolt into its housing by drilling a hole through the frame, for example along axis 50, and inserting a push rod therein to push the locking free end 13 of the bolt back into the lock housing thereby circumventing the lock mechanism and causing the door to open. To prevent this from being made, the arresting mechanism comprises a lock bar 51 which is engageable in a lock bar receiving cavity 52 which is formed in the side wall 53 of the bolt receiving sliding channel 15. The lock bar 51 is pivotally secured at pivot point 54 and is caused to move in and out of the cavity 52, in a manner as will be described later.

An actuating member 55 is provided to permit the positioning of the lock bar in the cavity. The member 55 has a pusher end 55' which engages the doorframe edge or striker plate 48 to displace the actuating member inwardly of the sliding channel to cause the lock bar to enter the cavity 52 under the influence of a piston, as will be described later. The lock bar 51 is moved out of the cavity 52 when the bolt retracting lever 22 is actuated, as will be describe later. This permits the retraction of the bolt into the housing by the use of the combination element 16.

Figure 13:
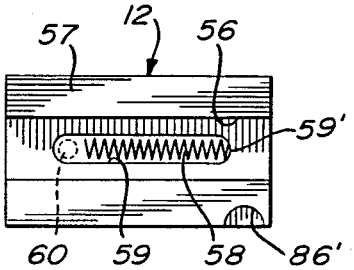
FIG. 13 is a view similar to FIG. 12 but with the actuating member removed.

Referring now to FIG. 13, it can be seen that the bolt 12 is provided with a flat axial slot 56 formed in a flat inner side wall 57 thereof. A spring 58 is located in a spring cavity 59 formed in the axial slot 56 and held in compression therein between a slot end wall 59' and a pin 60 secured to the actuating member 55 which is a flat elongated metal member. The member 55 has an engaging edge formed with an elevated end portion 61 for supporting the lock bar out of the cavity 52. A downwardly sloped portion 62 extends from the end portion 61 for guiding the arresting end portion 63 of the lock bar 51 in the cavity 52 when the actuating member 55 is displaced inwardly by the doorframe edge or striker plate 48 when the door is shut, as shown in FIG. 16. As can be seen, the lock bar supporting end portion 61 is moved deeper into the bolt sliding channel thus permitting the lock bar to slide down into the cavity 52, as illustrated in the fragmented rear view of FIG. 14.

Figure 11:
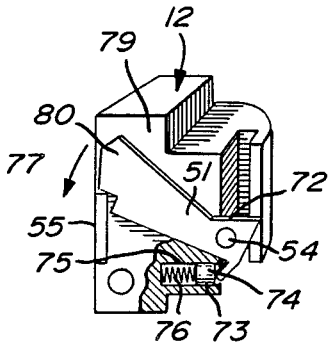
FIG. 11 shows the spring-biased bolt of the present invention and its internal arresting mechanism.
Figure 15:
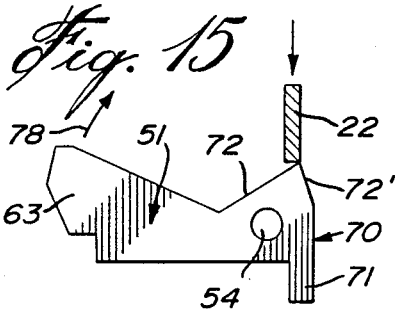
FIG. 15 is a plan view of the lock bar.

As more clearly shown in FIG. 15, the locking bar 51 is further provided with actuating means 70 at an end opposed to the arresting free end 63 to automatically move the lock bar in and out of the cavity. This actuating means will now be described, and it comprises an actuating portion located relative to the pivot connection 54. The actuating portion defines a piston responsive arm 71 and a retracting lever cam edge 72 to cause the lock bar 51 to pivot in opposed directions about the pivot connection or pivot axis 54. A spring-biased piston 73 having a piston head 74 is aligned with the piston responsive arm 71 and is biased outwardly of the cylindrical cavity 75 of the piston by a spring 76 whereby to apply an outward pressure on the piston responsive arm 71. Thus, when the actuating member 55 is moved inwardly of the bolt sliding channel or cavity 15 the piston 73 will cause the lock bar 51 to be displaced in the direction of arrow 77, as shown in FIG. 11, and enter the cavity 52. Accordingly, the bolt cannot be pushed inside its sliding channel nor can it move outside the sliding channel due to its retention by the lock bar 51.

As shown more clearly in FIG. 15, the retracting lever cam edge 72 is an angulated edge disposed on a top side of the opposed end of the piston responsive arm 71 and slopes upwardly toward the free and 72'.

As shown in FIG. 15, the bolt retracting lever 22 is disposed above the top part of the angulated edge 72, and specifically as illustrated in FIG. 15, and when the lever falls within the retracting cam slot 24 it applies downward pressure on this angulated edge 72 and causes the lock bar to pivot on the pivot point 54 in the direction of arrow 78 causing the arresting portion to move out of the locking cavity 52 and assume its position as shown in FIG. 11. Thus, immediately the bolt is free to be displaced inwardly within its sliding channel by rotating the bolt retracting cam 25.

As shown in FIG. 11 the rear wall of the bolt 12 is a flat wall 79, and the lock bar is also made from a flat piece of metal which is disposed onto this flat wall 79. The lock bar is further enlarged at its free end 80 to define a large head portion to provide a stronger arresting force.

Figure 14:
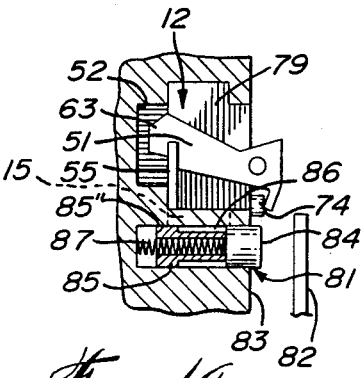
FIG. 14 is a fragmented rear view showing the lock bar in position and the bolt locked in the sliding channel.
Figure 17:
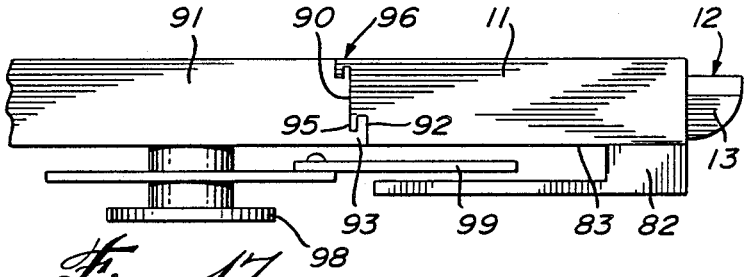
FIG. 17 is a top view showing the module connecting means provided with the lock housing.

As shown in FIG. 14, an arresting means in the form of a transverse spring-biased piston 81 is provided to lock the bolt 12 in an extended lock position when the rear cover 82 is not secured to the rear flat wall 83 of the lock housing 11 (see FIG. 17). As herein shown the piston 81 has opposed connected piston heads 84 and 85. Piston head 84 extends out of the rear wall 83 at one end of the piston, and the other piston head 85 at an opposed end which is disposed into a piston head cavity 86 (see FIG. 10) formed in the flat wall 83 and obstructing a lower portion of the lower sliding channel 15, as shown at 85' in FIG. 14. The spring 87 biases this piston 81 outwardly of the cavity 86, so that the piston head 85 enters the notch 86' (see FIGS. 12 and 13) formed in the inner side wall 57 of the bolt 12 and located in alignment with the lower portion 85' of the channel 15'. Accordingly, the rear piston head 85 engages in the notch 86' of the bolt and prevents the bolt from further sliding. As soon as the cover 82 is engaged with the housing 11, the piston head 85 is pushed inwardly in the cavity 86 and disengages from the notch 86' in the bolt, this further bolt arresting means is automatically disengaged when the cover 82 is secured to the rear wall 83.

Figure 18:
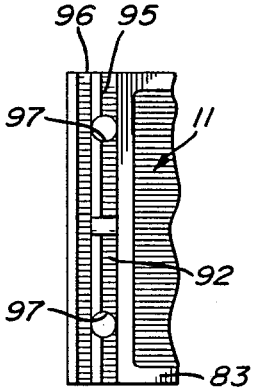
FIG. 18 is a fragmented rear view of the lock housing illustrating the construction of the module connecting means adjacent the rear wall thereof.

Referring now to FIG. 17 and 18, it can be seen that the lock housing 11 is provided with a connecting means in a rear wall 90 thereof for attaching a complementary timer module 91 thereto. The connecting means also has a locating means to locate the module at a precise position relative to the lock housing 11.

The locating means is comprised by a straight slot 92 formed at a recessed level below the rear wall 83. A straight rib 93 is formed along at least a portion of the straight slot 92, and a locating element 94 is disposed relative to the straight slot 92 transversely thereof. The rectangular module 91 also has a mating straight flat wall 95 also formed with an inverted straight slot and a rib portion, so that the rib portion of the module mates is close fit in the straight slot 92 of the lock housing, and vice versa. Accordingly, the module 91 is precisely aligned and mated with the lock housing 11.

As shown in FIG. 17 there are two such locating means in the rear wall 90 of the rectangular housing 11 with the second locating means being provided at 96.

As shown in FIG. 18, the connecting means comprises at least one threaded bore, herein two threaded bores 97 located in the straight slot 92. These bores receive a fastener (not shown) in threaded engagement therein whereby to secure the timer module 91 to the lock housing 11.

It is within the ambit of the present invention to cover any obvious modifications of the preferred embodiment described herein, provided such modifications fall within the scope of the appended claims.

I claim:

1. In a combination door lock having a lock housing, a spring-biased bolt having a locking free end, said bolt being spring-biased for sliding movement so that said free end is normally biased extending out of said housing, a manually operable combination element outside said housing, said combination element displacing one or more combination discs rotatable upon a common axis, each said one or more discs having a notch formed in an outer periphery thereof, a bolt retracting cam displaceable about said common axis, a bolt retracting lever pivotally connected to said bolt, said retracting lever having a retracting cam engaging means and a support pin supported on the outer periphery of said discs, said bolt retracting cam having means to engage said retracting cam engaging means, said one or more combination discs when positioned at a predetermined position by said combination element causing said notch(es) to align and said support pin to enter said notch(es) of said one or more discs and causing said retracting cam engaging means to engage said bolt retracting cam whereby upon further rotation of said combination element said bolt will be retracted by said bolt retracting lever, the improvement comprising self-cancelling combination means secured inside said housing and having disc engaging means for engaging one or more of said one or more combination discs when said one or more combination discs are positioned at said predetermined position, said disc engaging means being a spring-biased hook finger engaging in said notch of its associated combination disc for displacing its associated engaged disc out of position when said support pin moves out of said notch of said one or more discs prior to full retraction of said bolt by said retracting cam.

2. A combination door lock as claimed in claim 1 wherein said canceling combination means comprises a housing which is pivotally secured on a pivot, biasing means to retain said housing angulated with said hook finger disposed above said associated disc, and engaging means for releasable engagement with said retractable lever to cause said finger to engage with said notch of said associated disc when said support pin moves into said notch.

3. A combination door lock as claimed in claim 2 wherein said hook finger is an elongated flat finger extending partly into said housing, said finger having a spring engaging end disposed inside said housing and secured to a retracting spring secured thereto inside said housing, a stop means on said finger, and a hook free end for engaging said notch.

4. A combination door lock as claimed in claim 3 wherein said stop means is an abutment formed integral with said finger and abutting a front end of said housing to limit the retraction travel of said finger inside said housing.

5. A combination door lock as claimed in claim 3 wherein there are two or more of said combination discs, there being two of said hook fingers, each hook finger being aligned above a selected one of said two or more combination discs, and wherein each said finger is aligned with a peripheral edge of its associated selected one of said disc when said hook free end enters said notch and engages with a notch edge.

6. A combination door lock as claimed in claim 2 wherein said engaging means for releasable engagement with said retractable lever is a protruding element extending from said housing forwardly of said housing pivot, and a flange secured to said retractable lever disposed in alignment above said protruding element to press down on said protruding element to cause said housing to pivot toward said discs and said finger to engage said notch.

7. A combination door lock as claimed in claim 6 wherein said flange is displaced out of said alignment above said protruding element when said bolt is retracted whereby to free said housing for upward displacement when said finger moves out of such notch.

8. A combination door lock as claimed in claim 7 wherein said protruding element is a pin, said flange being integrally formed with said retracting lever.

9. A combination door lock as claimed in claim 2 wherein there are two or more of said combination discs, there being two of said hook fingers, each hook finger being aligned above a selected one of said two or more combination discs, each finger having a spring engaging end disposed inside said housing and secured to a retracting spring, said spring having each of said hook fingers having different spring tensions so as to displace their associated discs to different angles.

10. A combination door lock as claimed in claim 1 wherein said lock housing is provided with a straight flat end wall from which said bolt locking free end extends, and at least one other straight flat wall, said other straight wall having module connecting means for attaching a complementary lock module thereto, said connecting means having locating means and connecting means to locate and secure said module at a precise position relative to said lock housing.

11. A combination door lock as claimed in claim 10 wherein said locating means comprises a straight slot formed at a recessed level of said other straight flat wall, a straight rib formed along at least a portion of said straight slot, and a locating element disposed relative to said straight slot, said module having a mating straight flat wall also formed with an inverted straight slot and rib portion so that said rib portion of said module mates in close fit in said straight slot of said lock housing and vice-versa, and a cavity to receive said locating element in close fit therein.

12. A combination door lock as claimed in claim 11 wherein there are two of said locating means in said straight flat wall of both said lock housing and said module, said locating means being disposed in side-by-side parallel relationship and at different recessed levels.

* * * * *